US007017673B2

(12) United States Patent
Gargani

(10) Patent No.: US 7,017,673 B2
(45) Date of Patent: Mar. 28, 2006

(54) SPRINKLING HEAD FOR FIRE FIGHTING SYSTEMS

(76) Inventor: Armando Gargani, Via Ruggero Settimo, 4, I-20146, Milano (IT)

( * ) Notice: Subject to any disclaimer, the term of this patent is extended or adjusted under 35 U.S.C. 154(b) by 190 days.

(21) Appl. No.: 10/683,499

(22) Filed: Oct. 10, 2003

(65) Prior Publication Data

US 2004/0089752 A1 May 13, 2004

(30) Foreign Application Priority Data

Oct. 25, 2002 (IT) ..... MI2001A2283

(51) Int. Cl.
*A62C 37/08* (2006.01)
*A62C 39/00* (2006.01)
*A62C 37/36* (2006.01)

(52) U.S. Cl. ..... 169/37; 169/90; 169/38; 169/42; 169/19; 169/20

(58) Field of Classification Search ..... 169/37, 169/90, 38, 42, 19, 20, 17; 239/533.12, 476, 239/600

See application file for complete search history.

(56) References Cited

U.S. PATENT DOCUMENTS 5,018,586 A * 5/1991 Cawley et al. ..... 169/56
5,058,809 A * 10/1991 Carroll et al. ..... 239/428.5
5,732,511 A * 3/1998 Scott ..... 52/1
5,909,777 A * 6/1999 Jamison ..... 169/43
5,924,492 A * 7/1999 Kikuchi et al. ..... 169/37

* cited by examiner

*Primary Examiner*—Davis Hwu

(57) ABSTRACT

A sprinkling or spraying head, for fire fighting systems, comprises a nozzle holder cap which is removably coupled to the body of the sprinkling head and comprises a plurality of nozzles designed for ejecting a fighting liquid in a nebulized form.

3 Claims, 5 Drawing Sheets

SPRINKLING HEAD FOR FIRE FIGHTING SYSTEMS

BACKGROUND OF THE INVENTION

The present invention relates to a sprinkling head for a sprinkler assembly specifically designed for fire fighting systems.

According to a known method for protecting buildings from fire, a fighting liquid, such as water, is ejected or sprinkled through a plurality of nozzles, each of which comprises a heat sensor and is provided with a baffle arranged immediately near the nozzle in order to properly eject the liquid.

The deflecting baffler is so arranged as to break the water jet ejected by the nozzle to generate a plurality of small water droplets, the size of which are susceptible to vary from less than 1 mm, for example some microns, to several millimeters in diameter.

According to the above mentioned method, the differently sized water droplets will operate in different manners for extinguishing fire.

In the case of a large industrial fire, for example, the small sized droplets, having a diameter of about 500 micrometers or less, tend to fully evaporate, and provide the important function of cooling the environment atmosphere, specifically at the top or higher levels, near the sprinklers.

Large sized droplets, on the contrary, operate to penetrate the fume curtain to arrive at the fire surface, to extinguish fire.

However, conventional or prior sprinklers are not able of generating sufficiently fine droplets, and a main part of the liquid ejected by said prior sprinklers is constituted by droplets having middle sizes, thereby they are substantially inefficient in extinguishing fire.

Moreover, this water amount contributes to damaging the environment, in a degree larger than that of the fire itself, without providing any efficient fighting effects.

Moreover, prior sprinklers do not allow to properly adjust the water droplet size, unless the pressure of the supplied water is changed.

Such a droplet size adjusting method, however, is unsuitable, since it allows to provide only water droplets of a comparatively large size, under a low pressure, or of a comparatively small size, under high pressure, but not both large size and small size droplets.

Because of this lacking adjustment, it is necessary to use an amount of water much larger than that which would be actually useful, with large water amount usually generates damages greater than that caused by fire.

Moreover, to the above it is to be added that in a lot of cities it would not possible to connect the fighting system to the water system.

Accordingly, the available water would be very limited.

Thus, it would be very useful to use the available water with a great use efficiency.

SUMMARY OF THE INVENTION

Accordingly, the aim of the present invention is to provide such a sprinkling or spraying head, specifically designed for fighting systems, which is adapted to eject fighting liquid in a very efficient manner.

Within the scope of the above mentioned aim, a main object of the invention is to provide such a sprinkling head allowing to change the water nebulizing mode of operation, in a very simple and quick manner, according to requirements.

Yet another object of the present invention is to provide such a sprinkling or spraying head which is very reliable and safe in operation.

Yet another object of the present invention is to provide such a sprinkling head which can be used in prior fighting systems.

According to one aspect of the present invention, the above mentioned aim and object, as well as yet other objects, which will become more apparent hereinafter, are achieved by a sprinkling head, specifically designed for fighting systems, characterized in that said sprinkling head comprises a nozzle holding cap, removably coupled to a body of said head and including sprinkling nozzles for ejecting a nebulized liquid therefrom.

BRIEF DESCRIPTION OF THE DRAWINGS

Further characteristics and advantages of the present invention will become more apparent hereinafter from the following detailed disclosure of the preferred, though not exclusive, embodiment of the invention, which is illustrated, by way of an indicative, but not limitative, example in the accompanying drawings, where.

DESCRIPTION OF THE PREFERRED EMBODIMENTS

Figure 1:
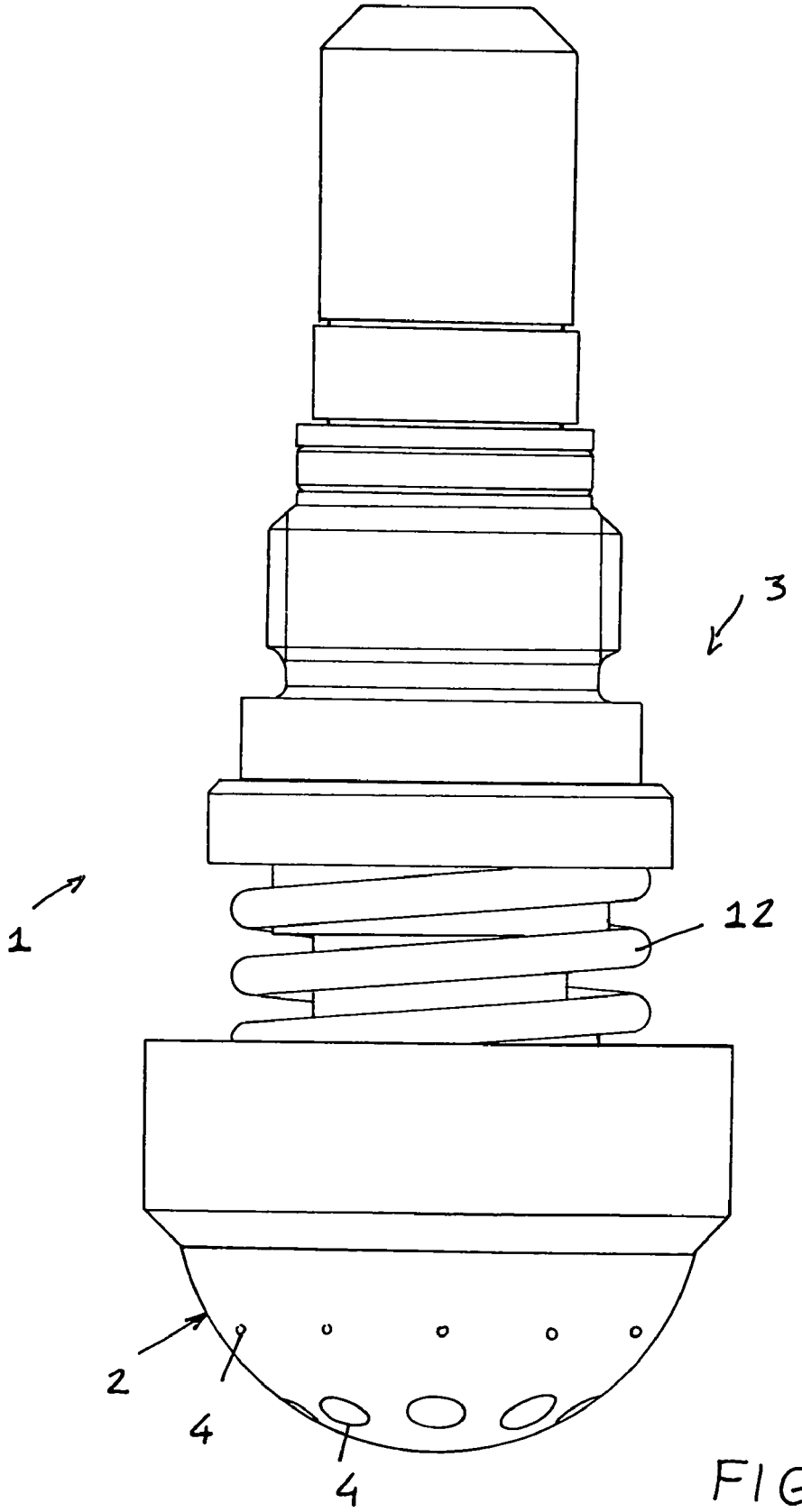
FIG. 1 is an elevation view of a sprinkling or spraying head according to the invention.

With reference to the number references of the above mentioned figures, the sprinkling or spraying head according to the present invention, which has been generally indicated by the reference number 1 comprises a cap 2, which is removably coupled, for example by a threaded type of connection, to the body 3 of the sprinkling head 1.

The body 3 of the sprinkling head 1 comprises an automatic opening device, designed for automatically enabling or opening the ejecting of a nebulized liquid, as the environment temperature exceeds a set temperature threshold.

As shown, the cap 2 defines an inner cavity 5, to which the liquid to be nebulized is conveyed, and comprises a plurality of nebulizing or atomizing nozzles 4.

Figure 2:
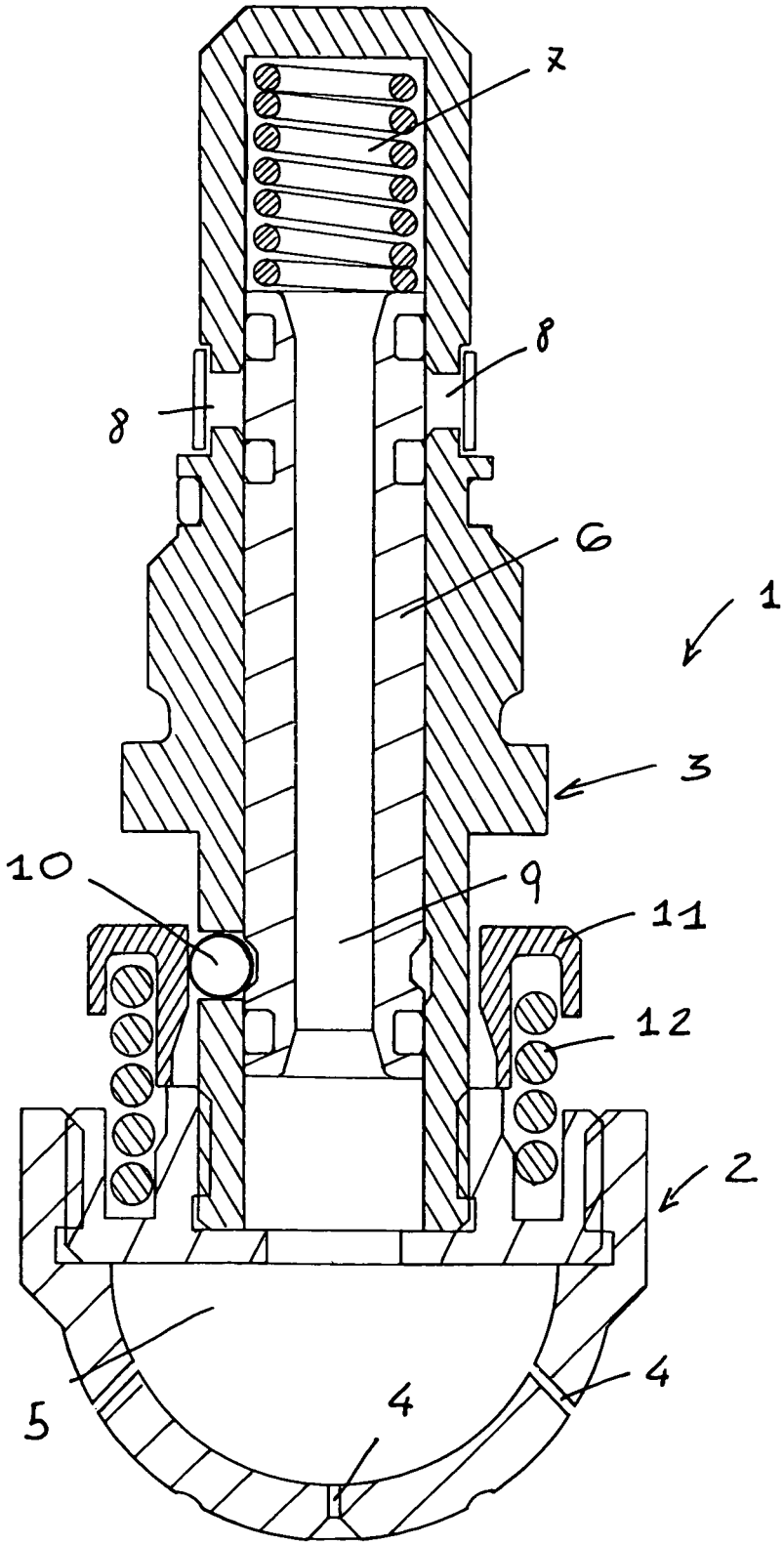
FIG. 2 is a further elevation view of the sprinkling head according to the invention, being shown in a closed position thereof.
Figure 3:
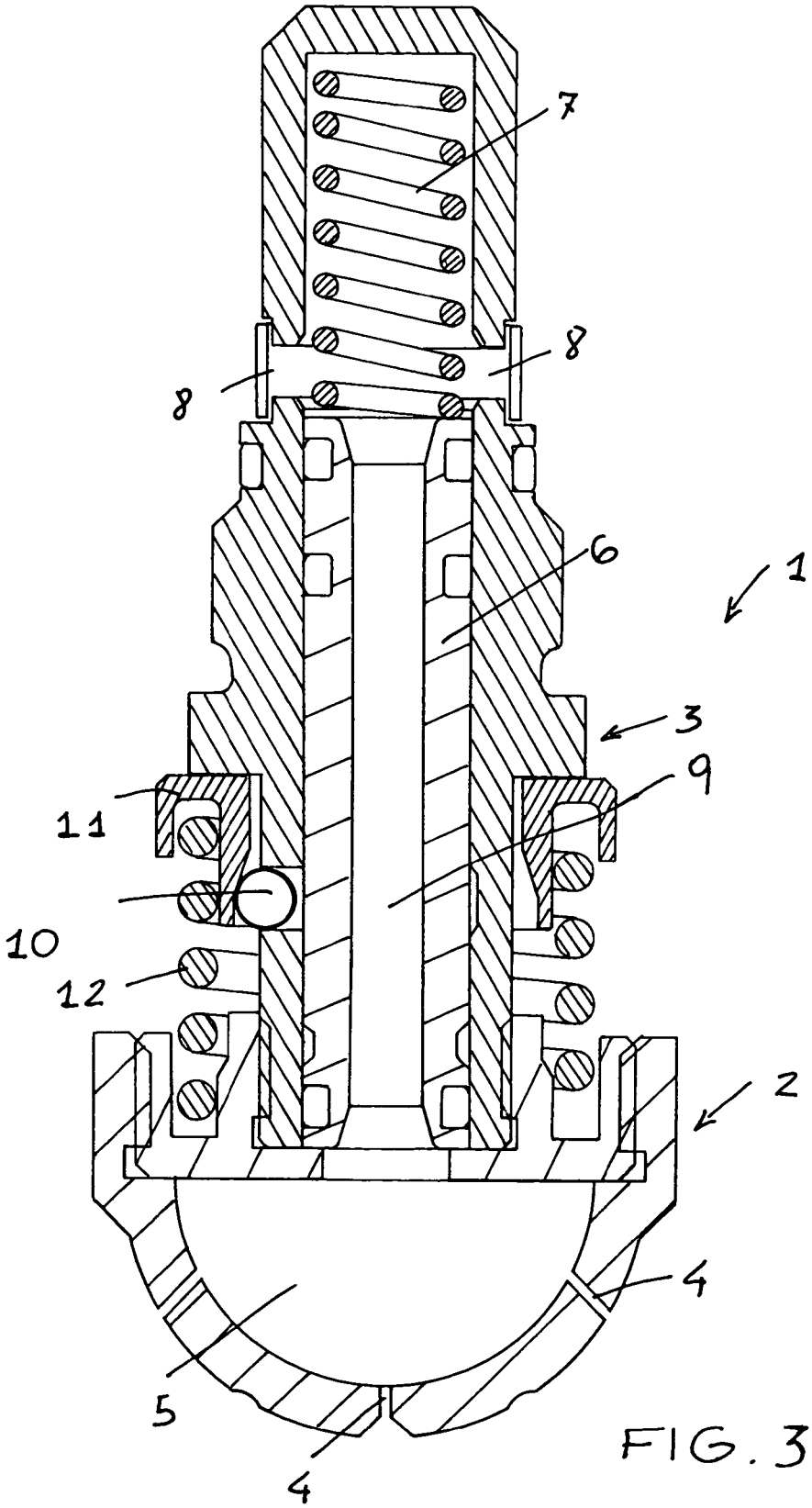
FIG. 3 is a further elevation view of the sprinkling head according to the invention, being shown in an open position thereof.
Figure 4:
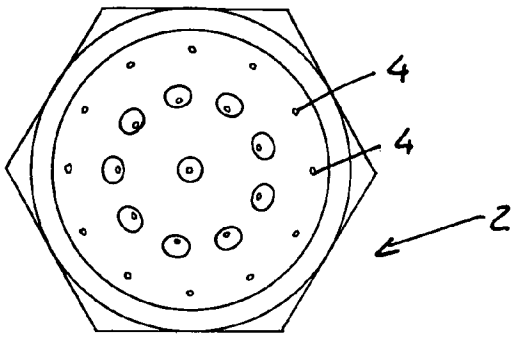
FIG. 4 is a top plan view of the cap included in the sprinkling head according to the invention.
Figure 5:
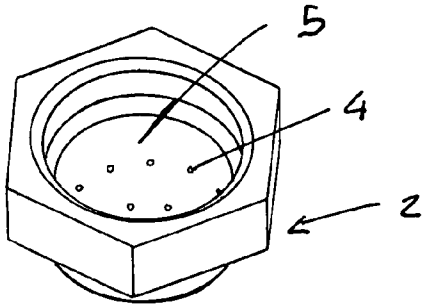
FIG. 5 is a top perspective view of the cap included in the sprinkling head according to the invention.
Figure 6:
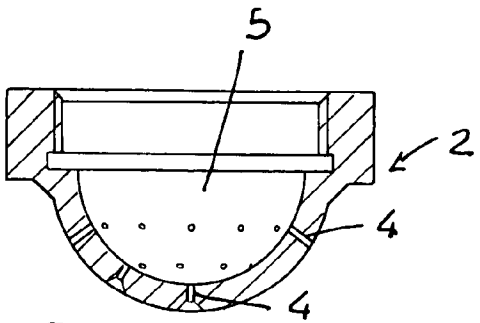
FIG. 6 is a cross sectional elevation view of the cap included in the sprinkling head according to the invention.
Figure 7:
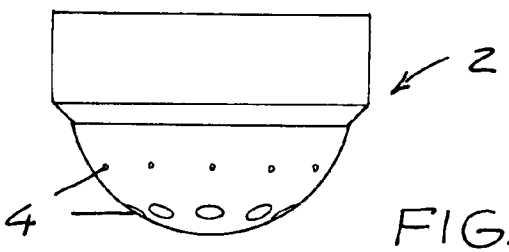
FIG. 7 is an alevation view of the cap.

The cap 2 is threaded to the body 3 of the head, which body holds in its inside a slider element 6 which can be driven against an urging spring 7, and is designed for defining a closed position, shown in FIG. 2, and an open position, shown in FIG. 3.

In its closed position, the slider element 6 closes the openings 8 of the body 3, thereby preventing any liquids for entering the inside of the head.

In its open position, on the contrary, the slider element 6 is so arranged as to clear the opening 8, thereby allowing the liquid to enter the head body, and, through an axial channel 9 formed in said slider element, to achieve the cavity 5 of the cap 2.

The automatic opening device, the operation of which will be disclosed in a more detailed manner hereinafter, comprises moreover disengaging ball elements 10 which are held in any desired position by a holding ring nut 11 and are suitable to engage the slider element 6, thereby setting the latter in its closing position (FIG. 2).

A shape memory or shape recovering type of spring 12 is designed for affecting the sealing ring nut 11 to automatically open the head, as it will be disclosed hereinafter.

In this connection it should be apparent that the mentioned spring can be replaced by any other suitable elements made of a shape recovery material, adapted to provide equivalent functions.

Accordingly the sprinkling head according to the present invention, provides two operating functions: a water supply function and an automatic opening function.

In its first operation or function, in which water is supplied, the liquid is conveyed from the water system into the head with suitable pressure from 2 to 200 bars.

Thus, the sprinkling head, by suitable arranging and shaping the spraying or sprinkling nozzles 4, will cause water to be nebulized under controlled speed and size conditions of the water droplets.

The fighting liquid, in particular, will be conveyed into the nozzle holder cap 2, and distributed inside of this cap so as to fill the cavity 5 of the latter, and it will exit the cap in a nebulized or atomized pattern, with nebulizing characteristics defined by the size of the nozzles 4.

As it should be apparent, the main characteristics or features of the nebulized water droplets would be their speed and size.

The operatively important parameter would be the diameter of the nozzle, the length of said nozzle, the pattern or arrangement of the plurality of nozzles, the configuration of the nozzle inlet and outlet cones, the inlet water pressure.

An analytic relationship exists between the droplet characteristics and the parameters defining or determining them.

Different types of fires can be extinguished by specifically designed characteristics of the nebulized water, and, accordingly, by adopting specifically designed nozzle holder caps.

In the sprinkling head according to the present invention, the nozzle holding cap is threaded to the remaining portion of the head and, accordingly, can be replaced even during the operation thereof.

For meeting its second function, the switching device included in the sprinkling head, as a set environment temperature threshold is exceeded, with automatically open the liquid inlet channel toward the delivery nozzles.

The sprinkling head, on the other hand, will be closed as the environment temperature Ta is less than a value Ts defined in designing the sprinkling head.

For Ta<Ts, the ball elements 10 are held in their designed position by the holding ring nut 11 and will engage the slider element 6 so as to hold it in such a position to prevent any liquid from entering.

The urging force applied by the urging spring 7 to the slider element 6 is partially transferred to the holding ring nut 11 through the ball elements 10 in the form of a friction force (Fa) between the ring nut and ball elements, thereby the ring nut 11 can be displaced only under a force larger than Fa.

For Ta<Ts, the spring or shape recovery element 12 will pass to its austenitic phase, thereby subjecting the ring nut 11 to an urging force.

For values of the latter force larger than Fa, the shape recovery spring 12 will urge and drive the ring nut 11 to a position suitable for disengaging the ball elements 10 thereby allowing the slider element 6 to slide according to the direction of the force applied to it by the urging spring 7.

Upon sliding, the liquid will freely enter the cavity 5 of the head 2, thereby existing the nozzle 4 in a nebulized or atomized form.

It should be pointed out that the force for performing this mode of operation does not depend on the fighting liquid pressure.

The two functions, i.e. the automatic supplying and opening functions, can also be provided in the head in a not simultaneous manner.

In particular, it is possible to provide a sprinkling head meeting only the first function.

Figure 8:
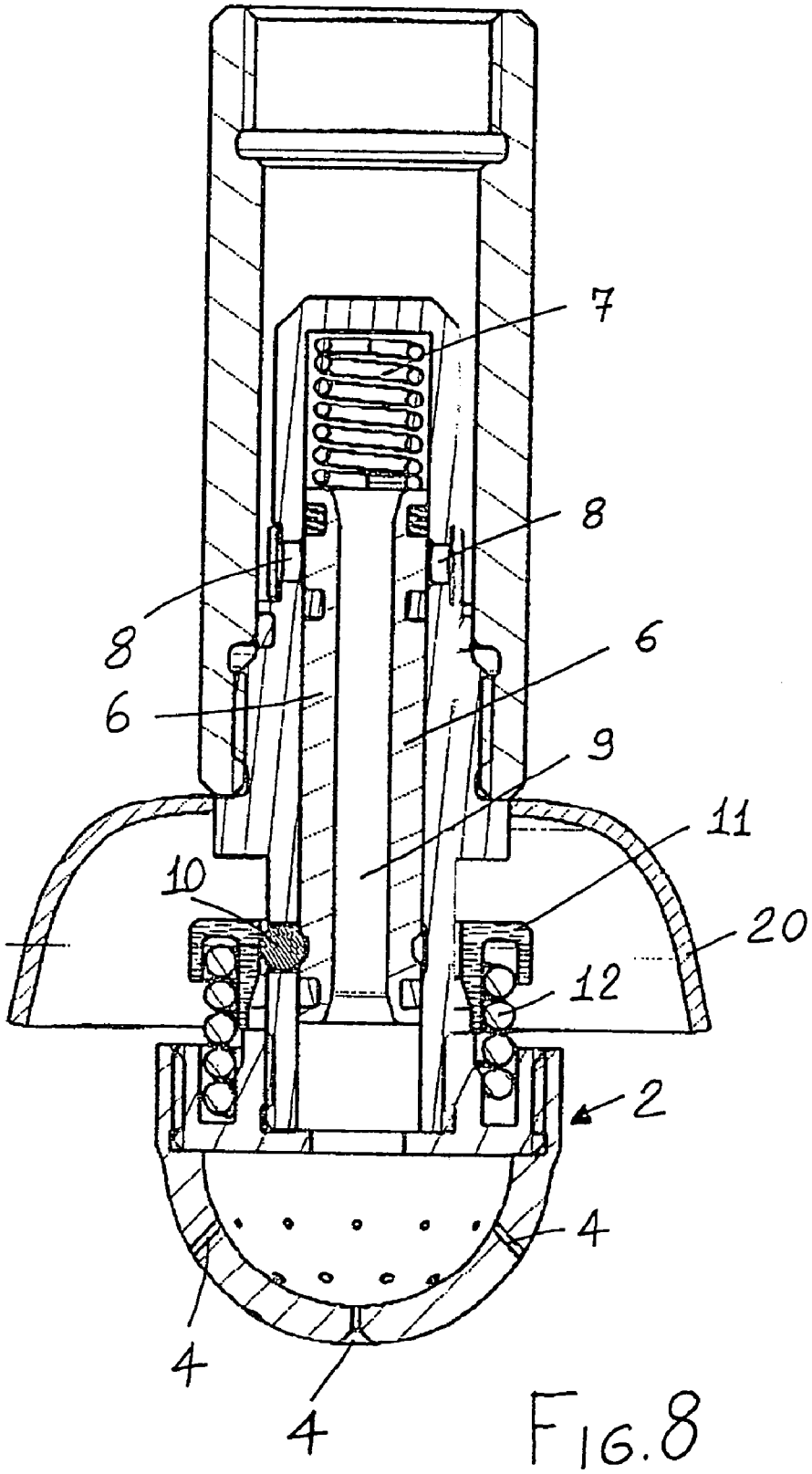
FIG. 8 illustrates a modified embodiment of the sprinkling head of the preceding figures, including a parabolic element adapted to reflect IF of infrared radiation toward and element made of a recoverable or shape memory material.

FIG. 8 shows a parabolic element 20 adapted to reflect infrared radiation toward the detail 12 made, as stated, of a shape recovery material.

It has been found that the invention fully achieves the intended aim and objects.

In fact the invention provides a sprinkling head suitable to eject fighting liquid in a nebulized or atomized pattern, and with a great efficiency, while requiring a comparatively small amount of liquid.

In practicing the invention the used materials, as well as the contingent size and shapes, can be any, according to requirements and the status of the art.

The invention claimed is:

1. A sprinkling head for fire fighting systems, said sprinkling head having a closed position and an open position and comprising a sprinkling nozzle holding a replaceable cap which is removably threaded to a body of said sprinkling head and includes a plurality of nozzles for ejecting a nebulized liquid and an inner cavity to which said liquid is conveyed, said body comprising a plurality of openings and an automatic opening device for automatically ejecting nebulized liquid as an environment temperature exceeds a set temperature threshold value, and wherein said body further comprises an inner slider element which can be driven against an urging spring for defining a closed position thereof said slider element closing said openings of said body thereby preventing said liquid from entering said sprinkling head, in said open position thereof said slider element clearing said opening thereby allowing said liquid to enter said body of said sprinkling head, to be conveyed, through and axial channel formed in said slider element, to said inner cavity of said cap.

2. A sprinkling head, according to claim 1, wherein said body comprises moreover a plurality of ball elements restrained by a holding ring nut and suitable to engage said slider element to restrain said slider element in said closed position thereof.

3. A sprinkling head, according to claim 2, said sprinkling head further comprising a shape recovery urging spring adapted to operate on said holding ring nut to automatically open said sprinkling head, wherein said sprinkling head is held in said closed position thereof as far as an environment temperature is less than a threshold temperature value, thereby said ball elements are held in a set position thereof by said holding ring nut and engaging said slider element to prevent any liquid from entering said head, said urging spring applying to said slide element an urging force which is partially transferred to said holing ring nut through said ball elements as a friction force between said holding ring nut and said ball elements, so as to allow said holding ring nut to be displaced only under a greater force, whereas, as said environment temperature exceeds said threshold temperature value, said shape recovery urging spring, by assuming and austenitic phase thereof, urges said holding ring nut to a position thereof clearing said ball elements thereby allowing said slider element to slide.

* * * * *